US009094750B2

(12) United States Patent
Fujise et al.

(10) Patent No.: US 9,094,750 B2
(45) Date of Patent: Jul. 28, 2015

(54) LOUDSPEAKER, INNER-EAR HEADPHONE INCLUDING LOUDSPEAKER, AND HEARING AID INCLUDING LOUDSPEAKER

(71) Applicant: Panasonic Intellectual Property Management Co., Ltd., Osaka (JP)

(72) Inventors: Akiko Fujise, Osaka (JP); Shuji Saiki, Nara (JP); Sawako Kano, Hyogo (JP); Toshiyuki Matsumura, Osaka (JP); Atsushi Sakaguchi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/003,466

(22) PCT Filed: Jan. 30, 2013

(86) PCT No.: PCT/JP2013/000499

§ 371 (c)(1),
(2) Date: Sep. 6, 2013

(87) PCT Pub. No.: WO2013/114872

PCT Pub. Date: Aug. 8, 2013

(65) Prior Publication Data

US 2014/0079258 A1 Mar. 20, 2014

(30) Foreign Application Priority Data

Jan. 30, 2012 (JP) ..... 2012-016758

(51) Int. Cl.
*H04R 1/00* (2006.01)
*H04R 9/06* (2006.01)
(Continued)

(52) U.S. Cl.
CPC ..... *H04R 9/027* (2013.01); *H04R 7/20* (2013.01); *H04R 9/06* (2013.01); *H04R 25/00* (2013.01);
(Continued)

(58) Field of Classification Search
CPC ..... H04R 9/022; H04R 9/025; H04R 9/027; H04R 31/00; H04R 31/006; H04R 2209/024
USPC ..... 381/412, 415, 419–420, 423
See application file for complete search history.

(56) References Cited

U.S. PATENT DOCUMENTS

2010/0014704 A1* 1/2010 Goschin et al. ..... 381/400
2010/0316249 A1 12/2010 Kamimura et al.
(Continued)

FOREIGN PATENT DOCUMENTS

JP 61-267499 11/1986
JP 2007-142836 6/2007
(Continued)

OTHER PUBLICATIONS

International Search Report mailed Mar. 12, 2013 in International (PCT) Application No. PCT/JP2013/000499.
(Continued)

*Primary Examiner* — Matthew Eason
(74) *Attorney, Agent, or Firm* — Wenderoth, Lind & Ponack, L.L.P.

(57) ABSTRACT

A loudspeaker includes: a frame; a yoke fixed to the frame; a magnet fixed to the yoke; a plate fixed to an upper surface of the magnet which is opposite to a surface of the magnet which is fixed to the yoke; a vibratable voice coil arranged in a first magnetic gap formed between the yoke and the plate; a diaphragm having an outer-edge portion joined to the voice coil; and a support member supporting the diaphragm in a vibratable manner, and composed of edges, one end of each edge being fixed to the frame. The plate is composed of: a flat-plate part fixed to the upper surface of the magnet, and having, at an upper surface thereof, a planar portion extending from the outer-edge portion up to a predetermined distance; and a protruding part disposed on the flat-plate part excluding the planar portion, and protruding toward the diaphragm.

11 Claims, 14 Drawing Sheets

(51) Int. Cl.

| | |
|---|---|
| ***H04R 11/02*** | (2006.01) |
| ***H04R 9/02*** | (2006.01) |
| ***H04R 7/20*** | (2006.01) |
| ***H04R 25/00*** | (2006.01) |
| *H04R 7/12* | (2006.01) |
| *H04R 1/10* | (2006.01) |
| *H04R 1/24* | (2006.01) |
| *H04R 7/04* | (2006.01) |
| *H04R 7/26* | (2006.01) |

(52) U.S. Cl.
CPC ..... *H04R 1/1016* (2013.01); *H04R 1/1075* (2013.01); *H04R 1/24* (2013.01); *H04R 7/04* (2013.01); *H04R 7/12* (2013.01); *H04R 7/26* (2013.01); *H04R 25/604* (2013.01)

(56) References Cited

U.S. PATENT DOCUMENTS

| | | | | |
|---|---|---|---|---|
| 2011/0044489 | A1 | 2/2011 | Saiki et al. | |
| 2013/0070955 | A1* | 3/2013 | Holt et al. ..... | 381/412 |

FOREIGN PATENT DOCUMENTS

| | | |
|---|---|---|
| JP | 2007-259196 | 10/2007 |
| JP | 2009-536481 | 10/2009 |
| WO | 2009/066415 | 5/2009 |

OTHER PUBLICATIONS

Extended European Search Report issued Jun. 15, 2015 in corresponding European Patent Application No. 13743387.6.

* cited by examiner

LOUDSPEAKER, INNER-EAR HEADPHONE INCLUDING LOUDSPEAKER, AND HEARING AID INCLUDING LOUDSPEAKER

TECHNICAL FIELD

The present disclosure relates to loudspeakers. More particularly, the present disclosure relates to a small-size loudspeaker capable of wideband reproduction, and an inner-ear headphone and a hearing aid each including the loudspeaker.

BACKGROUND ART

In recent years, with the spread of personal digital assistants and the spread of living style in which individuals personally enjoy video and music, demands for inner-ear headphones with high sound quality are increasing. The shape of an auditory pore into which an inner-ear headphone is inserted greatly varies among users. Therefore, in order to improve wearing sensations of many users, a small-size loudspeaker with a high degree of freedom in case design is demanded. In addition, as for a loudspeaker used in a receiver of a hearing aid, a small-size loudspeaker is demanded which has a wide frequency band for sound output, and causes a user to feel less discomfort or unpleasantness when it is inserted in his/her auditory pore.

As an example of a loudspeaker used for an inner-ear headphone or a hearing aid, a balanced armature type loudspeaker which is a kind of a magnetic loudspeaker is widely used. Although the balanced armature type loudspeaker can be reduced in size, since the displacement amplitude of an armature that drives a diaphragm is small because of the structure of the loudspeaker, it is difficult to reproduce a low-pitched sound which needs a large amplitude.

As a prior art literature relating to the present disclosure, Patent Literature 1 has been known, for example. Patent Literature 1 discloses a small-size electrodynamic loudspeaker capable of reproduction of low-pitched sound. In the loudspeaker, a support member that supports a diaphragm in a vibratable manner is composed of a plurality of edges, and a magnetic fluid fills a space between a voice coil and a plate, in a magnetic gap.

CITATION LIST

Patent Literature

[PTL 1] International Publication No. 2009/066415

SUMMARY OF THE INVENTION

Problems to be Solved by the Invention

In the structure of the conventional loudspeaker disclosed in Patent Literature 1, since the support member that supports the diaphragm in a vibratable manner is composed of a plurality edges, the stiffness of the support member can be reduced even when the loudspeaker is reduced in size, and therefore, the diaphragm can be operated at a large amplitude. Further, since the magnetic fluid fills a space between the voice coil and the plate in the magnetic gap, the magnetic fluid prevents a sound wave emitted from a back surface of the diaphragm from leaking to a front surface of the diaphragm via the magnetic gap, and canceling out a sound wave emitted from the front surface of the diaphragm. Thus, the sound pressure is improved. In the conventional loudspeaker, however, since the three-dimensional shape of the diaphragm is a dome shape in order to improve the stiffness of the entire diaphragm, a dome-shaped space is produced between the diaphragm and the plate. The volume of the dome-shaped space is greater than the volume of a space between a diaphragm and a plate in a loudspeaker having a plate-shaped diaphragm, and the flatness of sound pressure frequency characteristics is degraded due to a peak of acoustic resonance that occurs at a specific frequency. Particularly when the conventional loudspeaker is applied to a rear open type inner-ear headphone, a peak of acoustic resonance, which is caused by that the above dome-shaped space is produced and thereby the space between the diaphragm and the plate is increased, occurs in a high-pitched sound range in an audible band, and thus the sound quality is degraded in the high-pitched sound range.

The present disclosure takes into consideration the above problems, and has an object to provide a small-size loudspeaker that realizes broadband reproduction with excellent sound quality.

Solution to the Problems

In order to achieve the above object, a loudspeaker according to an embodiment of the present disclosure includes: a frame; a yoke fixed to the frame; a magnet fixed to the yoke; a plate fixed to an upper surface of the magnet, the upper surface being opposite to a surface of the magnet which is fixed to the yoke; a voice coil arranged, in a vibratable manner, in a first magnetic gap formed between the yoke and the plate; a diaphragm having an outer edge portion joined to the voice coil; and a support member which supports the diaphragm in a vibratable manner, and is composed of a plurality of edges, one end of each edge being fixed to the frame. The plate is composed of: a flat-plate part which is fixed to the upper surface of the magnet, and has, at an upper surface thereof, a planar portion extending from the outer edge portion up to a predetermined distance, and a protruding part which is disposed on the flat-plate part excluding the planar portion, and protrudes toward the diaphragm.

Advantageous Effects of the Invention

According to the present disclosure, it is possible to provide a small-size loudspeaker that realizes wideband reproduction with excellent sound quality.

DESCRIPTION OF EMBODIMENTS

Figure 15A:
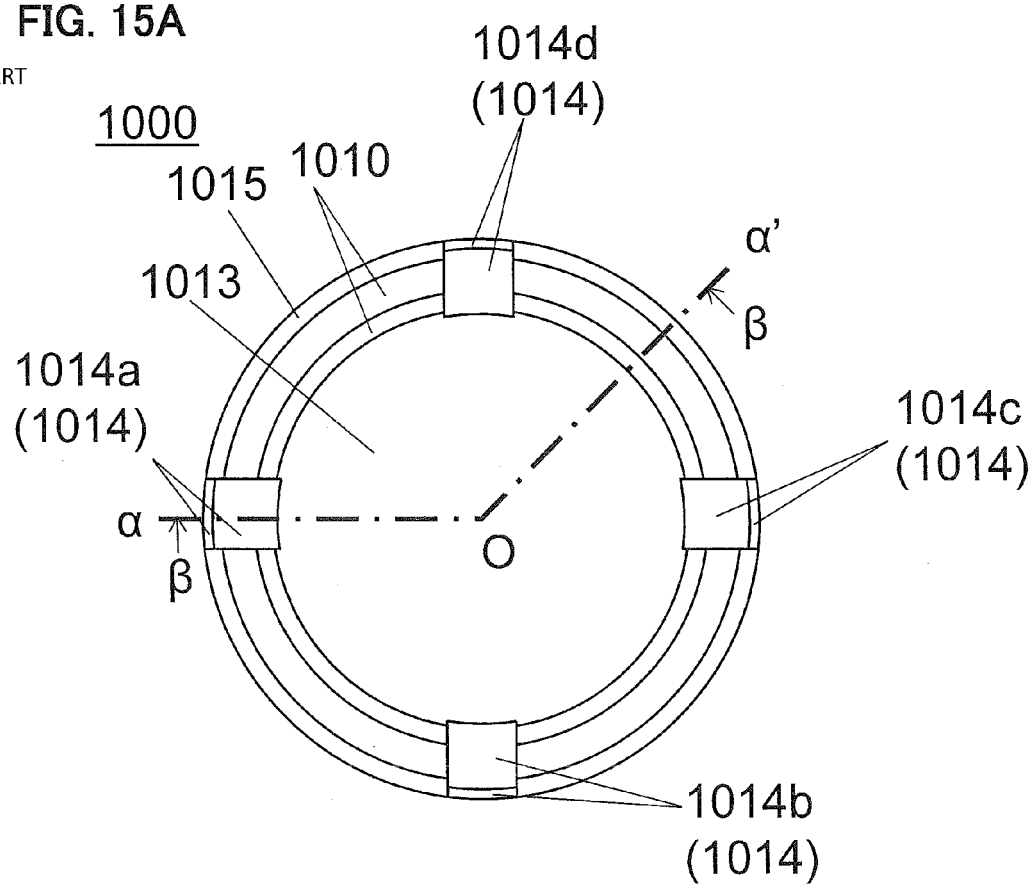
FIG. 15A PRIOR ART
FIG. 15A is a top view of the conventional loudspeaker.
Figure 15B:
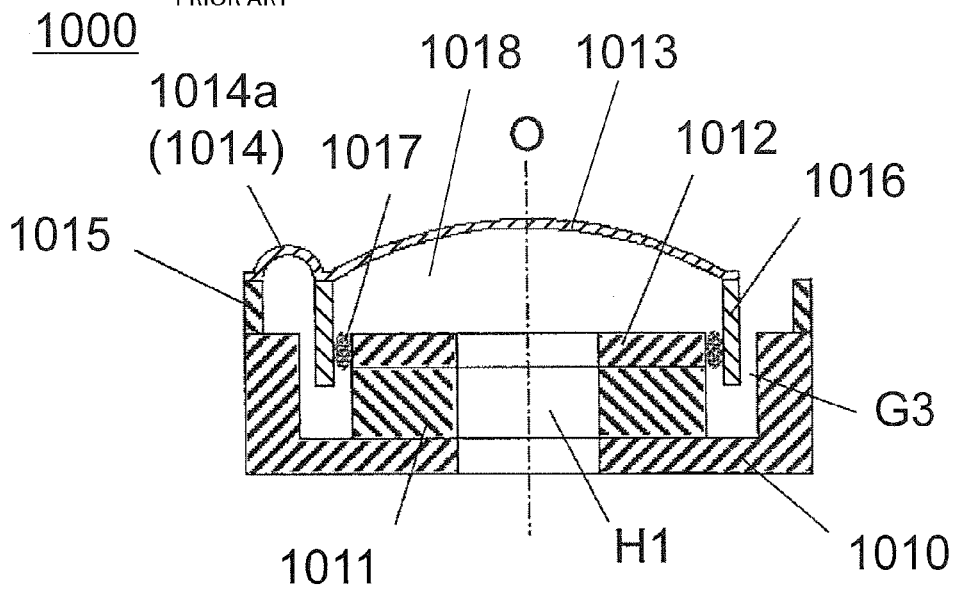
FIG. 15B PRIOR ART
FIG. 15B is a schematic cross-sectional view of the conventional loudspeaker, taken along a dashed-dotted line α-O-α' in FIG. 15A.

In order to describe the problems to be solved by the present disclosure, the conventional loudspeaker disclosed in Patent Literature 1 will be described with reference to the drawings. FIG. 15A is a top view of the conventional loudspeaker 1000. In the conventional loudspeaker 1000, a surface having a diaphragm 1013 is an upper surface. FIG. 15B is a schematic cross-sectional diagram taken along a dashed-dotted line α-O-α' in FIG. 15A, and viewed in the direction of an arrow β. The conventional loudspeaker 1000 includes a yoke 1010, a magnet 1011, a plate 1012, a diaphragm 1013, a support member 1014, a spacer 1015, a voice coil 1016, and a magnetic fluid 1017. The three-dimensional shape of the diaphragm 1013 is a dome shape, and the three-dimensional shape of the plate 1012 is a flat-plate shape. Further, the support member 1014 is composed of a plurality of edges 1014*a* to 1014*d*. The voice coil 1016 is held in a magnetic gap G3 produced by the yoke 1010 and the plate 1012. The magnetic fluid 1017 fills a space between the plate 1012 and the voice coil 1016, in the magnetic gap G3.

In the conventional loudspeaker 1000, the diaphragm 1013 is supported in a vibratable manner by the support member 1014, and the support member 1014 is composed of the plurality of edges 1014*a* to 1014*d*. Therefore, even if the entirety of the conventional loudspeaker 1000 is reduced in size, the stiffness of the support member 1014 can be reduced, which allows the diaphragm 1013 to operate at a large amplitude. Further, since the magnetic fluid 1017 fills the space between the plate 1012 and the voice coil 1016 in the magnetic gap G3, a sound wave emitted from the lower surface of the diaphragm 1013, the phase of which is opposite to the phase of a sound wave emitted from the upper surface of the diaphragm 1013, is prevented from leaking to the upper surface of the diaphragm 1013 via the magnetic gap G3, and canceling out the sound wave emitted from the upper surface of the diaphragm 1013. Thus, the sound pressure is improved.

In the conventional loudspeaker 1000, however, since the three-dimensional shape of the diaphragm 1013 is a dome shape in order to improve the stiffness of the entirety of the diaphragm 1013, a dome-shaped space 1018 is produced between the diaphragm 1013 and the plate 1012. The volume of the dome-shaped space 1018 is larger than the volume of a space between a diaphragm and a plate in a loudspeaker having a plate-shaped diaphragm. As a result, acoustic resonance occurs at a specific frequency, and the flatness of sound pressure frequency characteristics is degraded. Particularly when the conventional loudspeaker 1000 is applied to a lower-surface open type inner-ear headphone, a peak of acoustic resonance, which is caused by that the dome-shaped space 1018 is produced and thereby the space between the diaphragm 1013 and the plate 1012 is increased, occurs in a high-pitched sound range in an audible band, and thus the sound quality is degraded in the high-pitched sound range.

Figure 16:
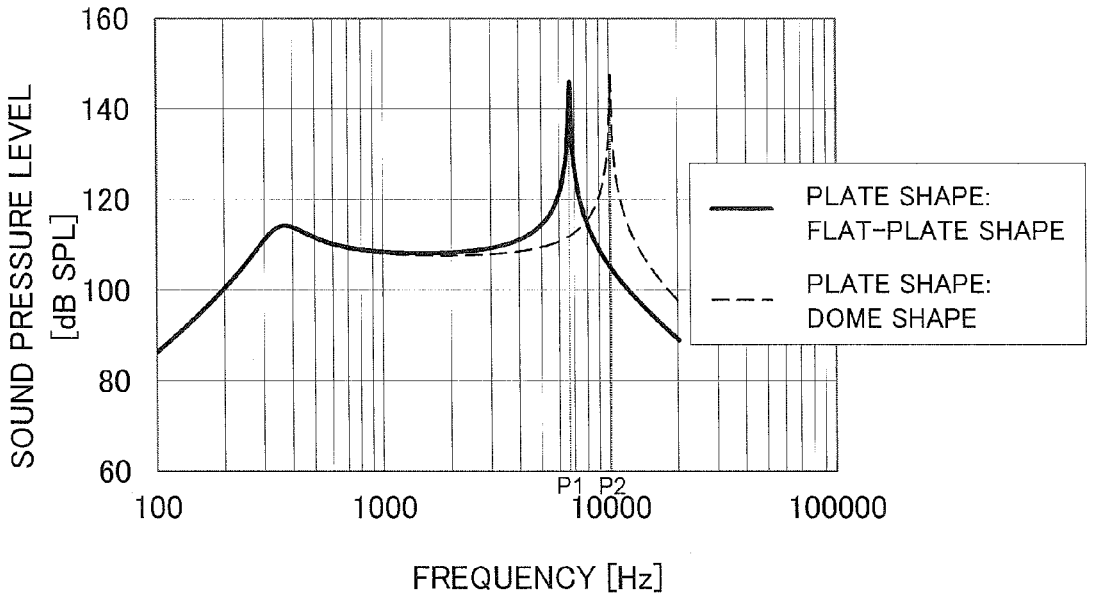
FIG. 16 PRIOR ART
FIG. 16 is a diagram showing the sound pressure frequency characteristics of two types of loudspeakers including plates of different shapes.

In view of the above-mentioned problems, a method is considered in which the three-dimensional shape of the plate 1012 is a dome shape substantially the same as that of the diaphragm 1013, thereby reducing the volume of the space between the diaphragm 1013 and the plate 1012. FIG. 16 shows the output sound pressure frequency characteristics obtained when an acoustic port is connected to each of the conventional loudspeaker 1000 and a loudspeaker similar to the conventional loudspeaker 1000, in which the three-dimensional shape of the plate 1012 is a dome shape substantially the same as that of the diaphragm 1013. As is apparent from FIG. 16, when the three-dimensional shape of the plate 1012 is a dome shape substantially the same as that of the diaphragm 1013, the volume of the space between the plate 1012 and the diaphragm 1013, which influences the acoustic resonance, is reduced, and the peak of the acoustic resonance shifts from P1 to P2, that is, shifts toward higher frequencies, and thereby the frequency band in which the sound pressure frequency characteristics are flat can be extended to the higher frequency band.

In the conventional loudspeaker 1000, however, when the three-dimensional shape of the plate 1012 is a dome shape substantially the same as that of the diaphragm 1013, the gap between the diaphragm 1013 and the outer peripheral portion of the upper surface of the plate 1012 is narrower than that in the case where the three-dimensional shape of the plate 1012 is a flat-plate shape, the magnetic fluid 1017 is likely to be drawn to the gap between the diaphragm 1013 and the outer peripheral portion of the upper surface of the plate 1012, and the magnetic fluid 1017 is likely to move from the lateral surface of the plate 1012 to the upper surface thereof. As a result, the possibility of flow of the magnetic fluid 1017 to the upper surface of the plate 1012 is increased. If the magnetic fluid 1017 flows to the upper surface of the plate 1012, the amount of the magnetic fluid 1017 held in the magnetic gap G3 is decreased, and the sound wave emitted from the lower surface of the diaphragm 1013, which has been blocked by the magnetic fluid 1017 filling the gap G3, leaks to the front surface of the diaphragm 1013, which might cause reduction in the sound pressure. Accordingly, in the case where the three-dimensional shape of the plate 1012 is a dome shape substantially the same as that of the diaphragm 1013, it is difficult to maintain the sound pressure output performance.

Therefore, the inventors of the present disclosure have devised a small-size loudspeaker which realizes broadband reproduction with excellent sound quality.

Various aspects of the present disclosure based on the newly devised loudspeaker are as follows.

A loudspeaker according to an aspect of the present disclosure includes: a frame; a yoke fixed to the frame; a magnet fixed to the yoke; a plate fixed to an upper surface of the magnet, the upper surface being opposite to a surface of the magnet which is fixed to the yoke; a voice coil arranged, in a vibratable manner, in a first magnetic gap formed between the yoke and the plate; a diaphragm having an outer edge portion joined to the voice coil; and a support member which supports the diaphragm in a vibratable manner, and is composed of a plurality of edges, one end of each edge being fixed to the frame. The plate is composed of: a flat-plate part which is fixed to the upper surface of the magnet, and has, at an upper surface thereof, a planar portion extending from the outer edge portion up to a predetermined distance; and a protruding part which is disposed on the flat-plate part excluding the planar portion, and protrudes toward the diaphragm.

According to this aspect, it is possible to prevent a magnetic fluid from flowing to the upper surface of the plate while improving the reproduction performance in the high-pitched sound range.

In another aspect, when the diaphragm is displaced toward the plate at a maximum amplitude, the length of a vertical line extending from a point on the planar portion, closest to the protruding part, to the diaphragm is larger than the distance between an inner side of the voice coil and a lateral surface of the flat-plate part.

According to this aspect, even when the distance between the diaphragm and the upper surface of the plate becomes shortest, the magnetic fluid is reliably prevented from flowing to the upper surface of the plate.

In another aspect, the three-dimensional shape of the diaphragm is a dome shape.

In another aspect, the shape of an upper surface of the protruding part is similar to the three-dimensional shape of the diaphragm.

In another aspect, an air flow path is provided through the protruding part.

According to this aspect, the air resistance at the surface of the protruding part can be increased, and thereby the protruding part can be used as a braking member.

In another aspect, a step-like cutout is formed in an outer edge portion of the flat-plate part including the planar portion.

According to this aspect, flow of the magnetic fluid to the upper surface of the plate can be prevented more effectively, and thereby the required filling amount of the magnetic fluid can be reduced.

In another aspect, an oil-repellent agent is applied to only the planar portion.

According to this aspect, flow of the magnetic fluid to the upper surface of the plate can be prevented more effectively.

In another aspect, a low magnetic permeability material is used as a material of the protruding part, and a high magnetic permeability material is used as a material of the flat-plate part.

According to this aspect, a magnetic flux passing the voice coil can be concentrated, and a force that moves the magnetic fluid toward the upper surface of the plate is prevented from acting on the magnetic fluid.

In still another aspect of the present disclosure, the above-mentioned loudspeaker may be provided in an inner-ear headphone or a hearing aid.

Hereinafter, embodiments will be described in detail with reference to the drawings as appropriate. However, there will be instances in which detailed description beyond what is necessary is omitted. For example, detailed description of subject matter that is previously well-known, as well as redundant description of components that are substantially the same will in some cases be omitted. This is to prevent the following description from being unnecessarily lengthy, in order to facilitate understanding by a person of ordinary skill in the art. The applicant provides the following description and the accompanying drawings in order to allow a person of ordinary skill in the art to sufficiently understand the present disclosure, and the description and the drawings are not intended to restrict the subject matter of the scope of the patent claims.

Embodiment 1

Figure 1A:
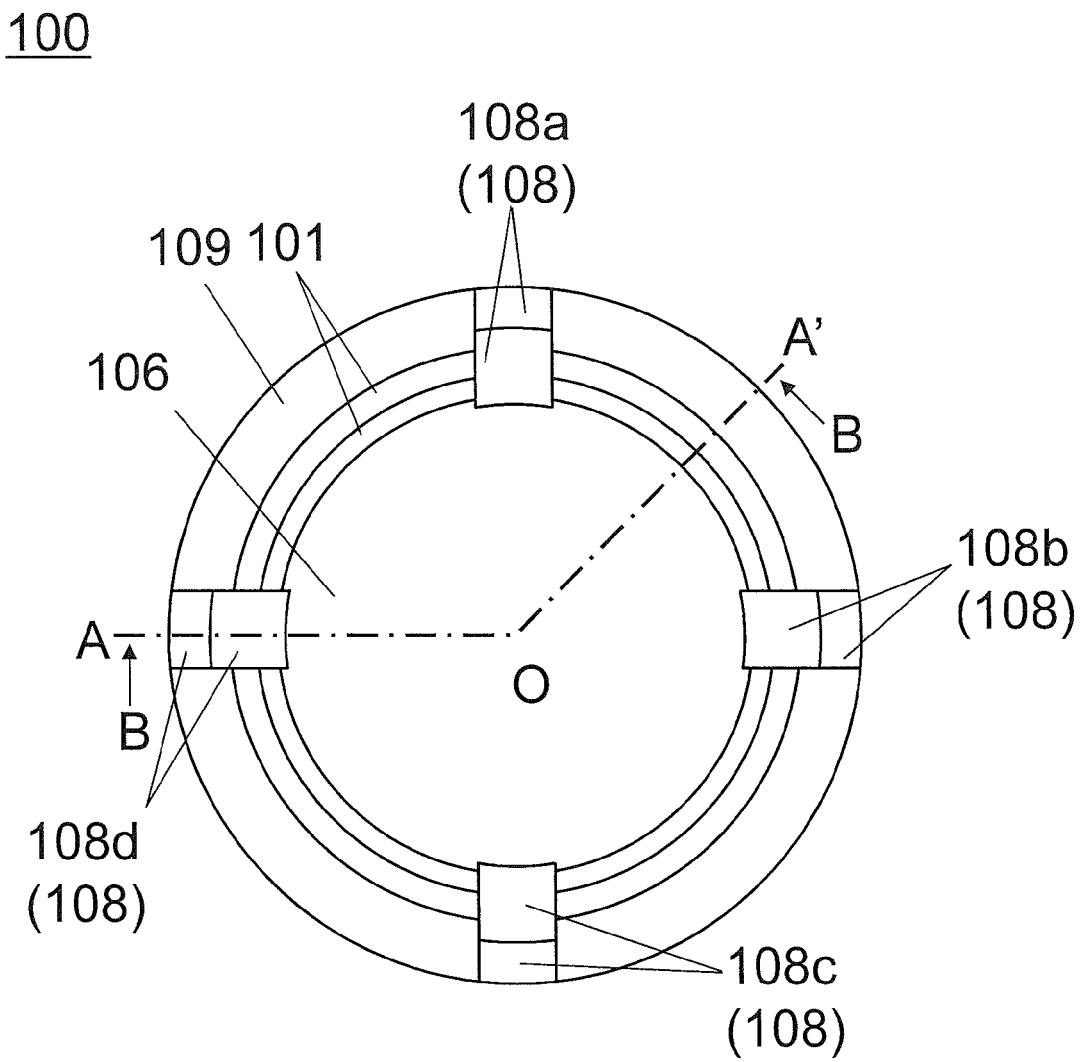
FIG. 1A is a top view of a loudspeaker according to Embodiment 1 of the present disclosure.
Figure 1B:
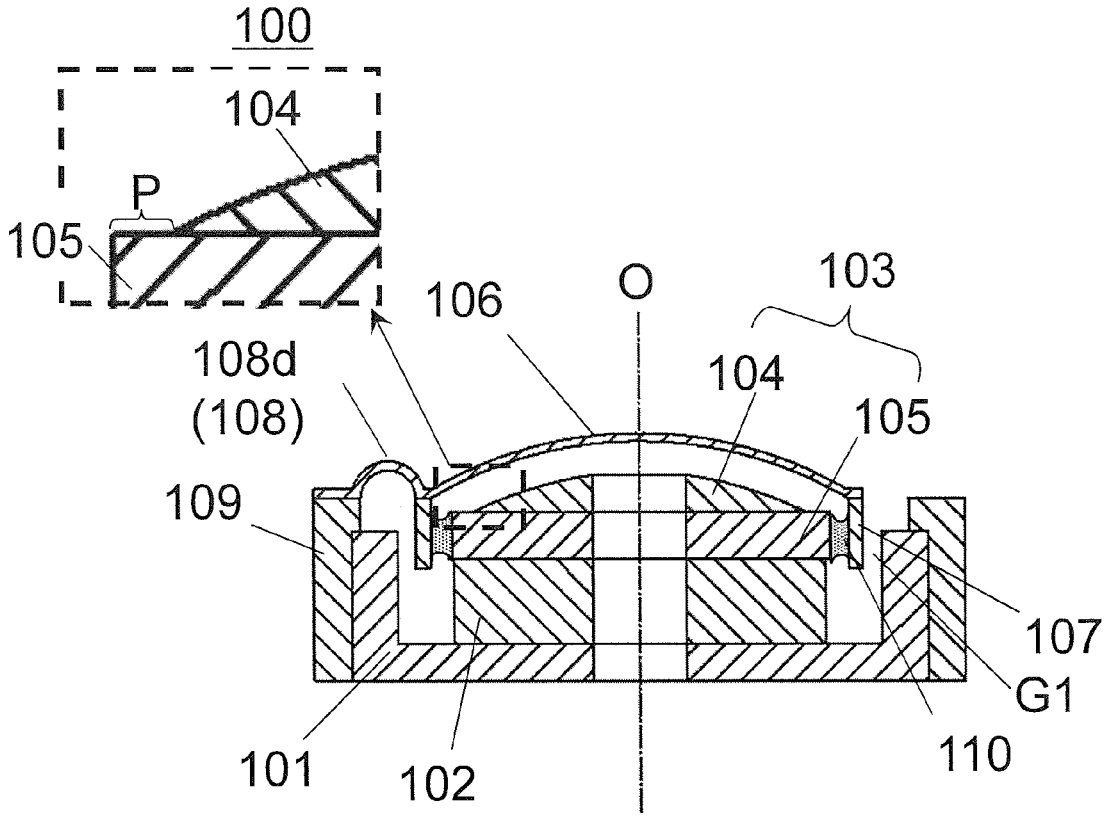
FIG. 1B is a schematic cross-sectional diagram taken along a dashed-dotted line A-O-A' in FIG. 1A.

Hereinafter, Embodiment 1 will be described. First, the structure of a loudspeaker 100 according to the present embodiment will be described. FIG. 1A is a top view of the loudspeaker 100 according to the present embodiment. In the loudspeaker 100, the side of a surface having a diaphragm 106 is an upper side. FIG. 1B is a schematic cross-sectional diagram taken along a dashed-dotted line A-O-A' in FIG. 1A, and viewed in the direction of an arrow B.

The loudspeaker 100 includes a yoke 101, a magnet 102, a plate 103, a diaphragm 106, a voice coil 107, a support member 108, a frame 109, and a magnetic fluid 110. The plate 103 is composed of a protruding part 104 and a flat-plate part 105. As shown in FIG. 1A, the loudspeaker 100 has a circular shape when viewed from the top. As shown in FIG. 1B, the magnet 102 is fixed to a box-shaped yoke 101 whose upper surface is opened. The flat-plate part 105 of the plate 103 is fixed to an upper surface of the magnet 102. The protruding part 104 of the plate 103 is formed on an upper surface of the flat-plate part 105. A magnetic gap G1 is produced between the yoke 101 and the plate 103. The voice coil 107 is arranged in the magnetic gap G1 so as to be vibratable in the vertical direction. The magnetic fluid 110 fills a space between the flat-plate part 105 of the plate 103 and the voice coil 107, in the magnetic gap G1. Further, a hole produced by the yoke 101, the magnet 102, and the plate 103 serves as a through-hole along a center axis O. A peripheral edge portion of the diaphragm 106 is joined to the upper surface of the voice coil 107. The support member 108 is composed of a plurality of edges (in FIG. 1A, four edges 108*a* to 108*d*). The edges 108*a* to 108*d* support the diaphragm 106 in a vibratable manner, and are arranged so as to connect the diaphragm 106 to the frame 109. The cross-sectional shape of each of the edges 108*a* to 108*d* is an upward-convex curve as shown in FIG. 1B.

Next, the shape of the plate 103 will be described in detail. A diagram in an upper-left area in FIG. 1B shows an enlarged portion of the plate 103. The plate 103 is composed of the protruding part 104 and the flat-plate part 105. At an upper surface of the plate 103, the flat-plate part 105 has a planar portion P extending from its outer edge portion up to a predetermined distance. Further, the protruding part 104 is formed on the upper surface of the flat-plate part 105 excluding the planar portion P, and an upper surface of the protruding part 104 has a three-dimensional shape substantially the same as that of the diaphragm 106.

Next, the operation of the loudspeaker 100 configured as described above will be described. When an electric signal is input to the voice coil 107, the voice coil 107 vibrates in accordance with the Fleming's left hand rule. Since the voice coil 107 is joined to the diaphragm 106, the diaphragm 106 vibrates in the same direction as the vibration of the voice coil 107. The vibration of the diaphragm 106 causes a change in the pressure of the air above and below the diaphragm 106, and thus a sound wave is generated from the diaphragm 106. By using either the upper surface or the lower surface of the diaphragm 106 as a sound emitting surface, auditory hearing is realized. Since the magnetic fluid 110 fills the space between the flat-plate part 105 of the plate 103 and the voice coil 107 in the magnetic gap G1, the sound waves of opposite phases, which are generated at the upper surface and the lower surface of the diaphragm 106, are prevented from reaching the lower surface and the upper surface, respectively, thereby preventing reduction in the reproduced sound pressure. Further, since the plate 103 is composed of the protruding part 104 and the flat-plate part 105, the volume of the space produced between the upper surface of the plate 103 and the diaphragm 106 can be reduced, and thus the frequency band in which the sound pressure frequency characteristics are flat can be extended to the higher frequency band.

Figure 2A:
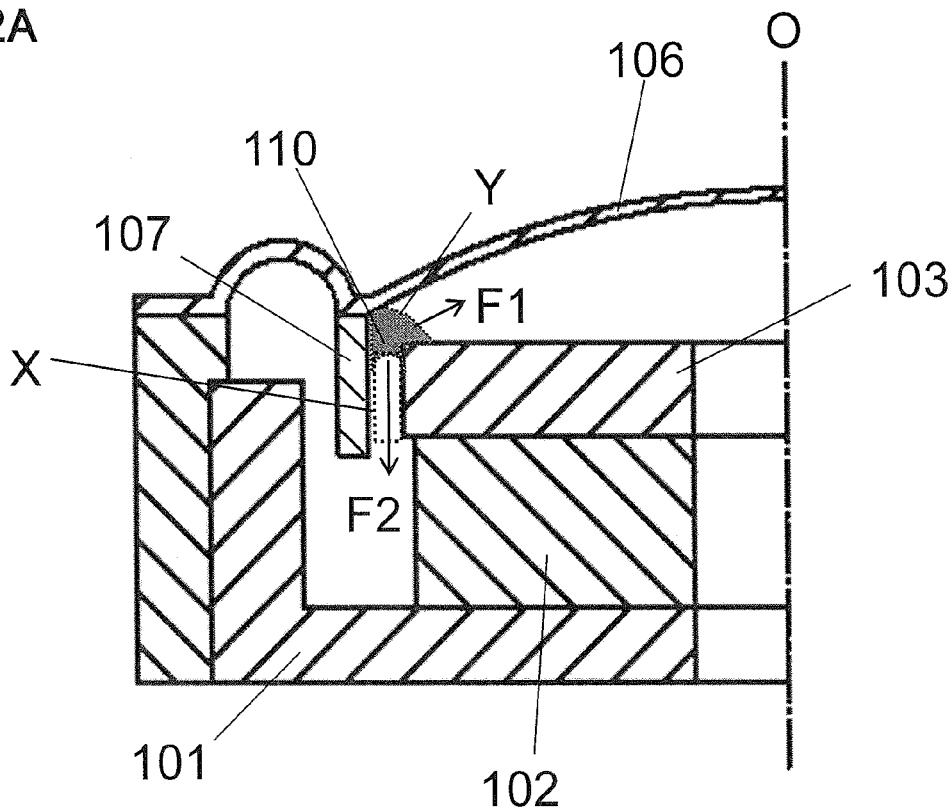
FIG. 2A is a diagram showing a holding state and a movement manner of a magnetic fluid in a case where the shape of a plate is flat.
Figure 2B:
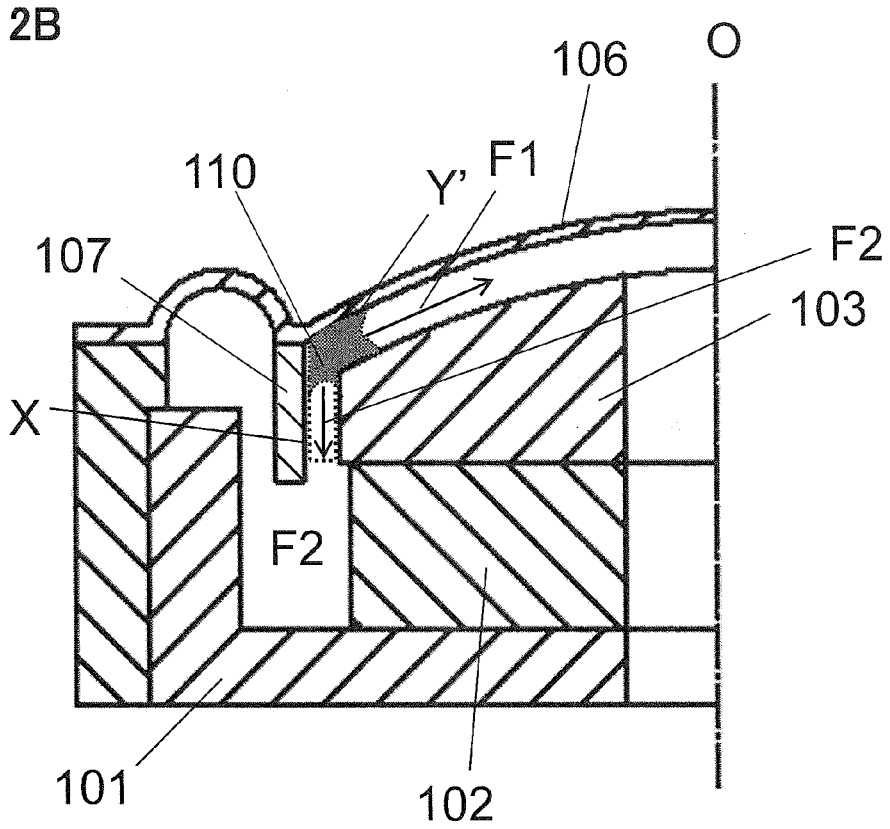
FIG. 2B is a diagram showing a holding state and a movement manner of a magnetic fluid in a case where the shape of a plate is a dome-shape.
Figure 2C:
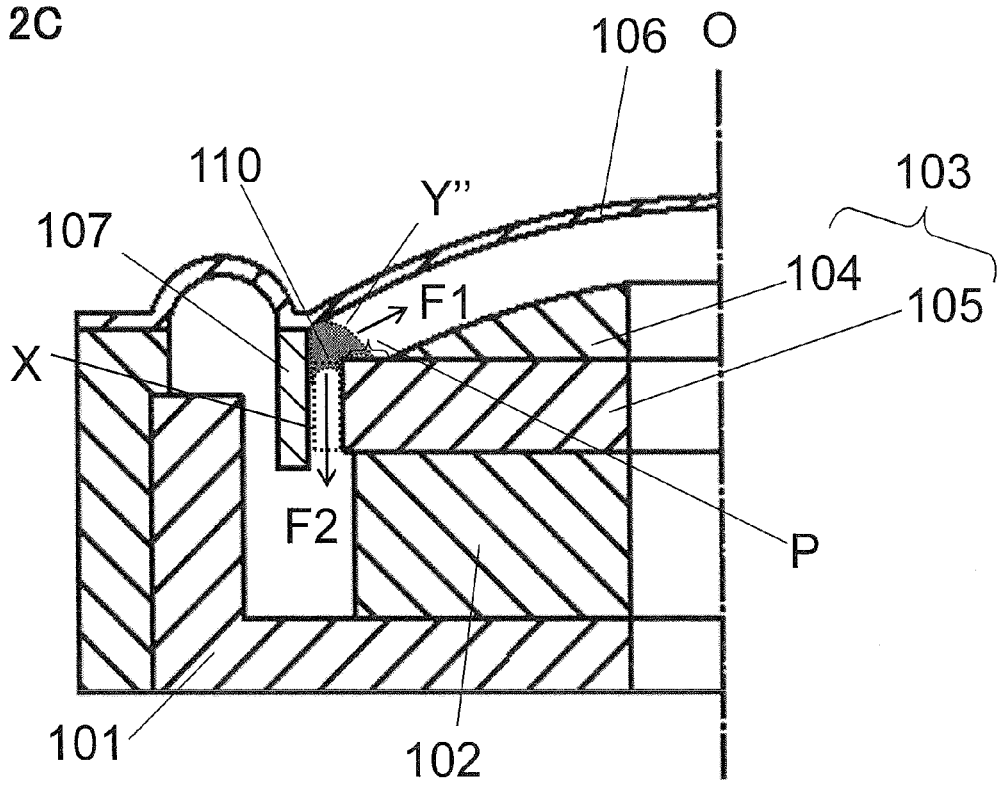
FIG. 2C is a diagram showing a holding state and a movement manner of a magnetic fluid in a case where a plate has a flat-plate part and a protruding part.

Next, the holding state and the movement manner of the magnetic fluid 110, which vary depending on the shape of the plate 103, will be described. FIG. 2A is a diagram showing the holding state and the movement manner of the magnetic fluid 110 in the case where the shape of the plate 103 is a flat-plate shape that is adopted in the conventional loudspeaker. FIG. 2B is a diagram showing the holding state and the movement manner of the magnetic fluid 110 in the case where the shape of the plate 103 is a dome shape that is proposed as an improvement of the conventional loudspeaker. In addition, FIG. 2C is a diagram showing the holding state and the movement manner of the magnetic fluid 110 in the case where the plate 103 is shaped so as to have a flat-plate part and a protruding part, which is the shape according to the present embodiment. In each of FIGS. 2A to 2C, the side of a surface having the diaphragm 106 is an upper side, and the holding state and the movement manner of the magnetic fluid 110 at a position corresponding to a cross section taken along a dashed-dotted line A-O in FIG. 1A will be described.

The magnetic fluid 110 is held within a range X such that a force F1 that acts to draw the magnetic fluid 110 into the space between the diaphragm 106 and the upper surface of the plate 103 and a force F2 that brings the magnetic fluid 110 back to the range X are balanced with each other by balancing of three kinds of forces, i.e., a cohesive force of molecules of the magnetic fluid 110 itself, an adhesive force that acts at a boundary between the magnetic fluid 110 and the neighboring part in contact with the magnetic fluid 110, and a magnetic force that is caused by a magnetic field formed by the magnet 102, the yoke 101, and the plate 103 and acts on the magnetic fluid 110. Since the magnetic fluid 110 distributes in an annular shape, a force in a circumferential direction of the outer periphery of the plate 103 also acts on the magnetic fluid 110. However, this force is ignored to simplify the description. Hereinafter, a description will be given of the forces that act on the magnetic fluid 110 when the magnetic fluid 110 moves to ranges Y, Y', and Y" on the upper surface side of the plate 103 due to reasons such as a bias in the injection state of the magnetic fluid 110 during manufacture, an external force due to an impact from dropping, a large amplitude operation of the diaphragm 106, with reference to FIGS. 2A to 2C.

In the state shown in FIG. 2A, when the magnetic fluid 110 moves to the range Y on the upper surface side of the plate 103, the surface area of the magnetic fluid 110 that is exposed to the space between the diaphragm 106 and the plate 103 is increased, and therefore, the cohesive force of molecules of the magnetic fluid 110 itself acts so as to bring the magnetic fluid 110 back to the range X. Further, when the magnetic fluid 110 moves to the upper surface of the plate 103, assuming that the surface with the diaphragm 106 faces upward, a downward component in the vertical direction, of the magnetic force that acts on the magnetic fluid 110, increases along a magnetic flux distribution produced by the yoke 101, the magnet 102, and the plate 103. As a result of these forces, the force F2 that acts to bring the magnetic fluid 110 back to the range X becomes larger than the force F1 that acts to draw the magnetic fluid 110 into the space between the diaphragm 106 and the upper surface of the plate 103. Therefore, even if the magnetic fluid 110 temporarily moves to the range Y on the upper surface side of the plate 103, the magnetic fluid 110 returns to the range X, and thus the magnetic fluid 110 can be held between the plate 103 and the voice coil 107.

On the other hand, in the state shown in FIG. 2B, since the space between the diaphragm 106 and the upper surface of the plate 103 is narrow, if the magnetic fluid 110 moves to the range Y' on the upper surface side of the plate 103, the area of the magnetic fluid 110 that contacts the diaphragm 106 and the upper surface of the plate 103 is larger than that in the state shown in FIG. 2A. Accordingly, as compared to the state shown in FIG. 2A, the adhesive force strongly acts to draw the magnetic fluid 110 into the space between the diaphragm 106 and the upper surface of the plate 103. Further, as compared to the state shown in FIG. 2A, the amount of increase in the surface area of the magnetic fluid 110 that is exposed to the space between the diaphragm 106 and the upper surface of the plate 103 is small, and therefore, the cohesive force of molecules of the magnetic fluid 110 itself, which acts to bring the magnetic fluid 110 back to the range X, becomes small. As a result, the force F1 that acts to draw the magnetic fluid 110 into the space between the diaphragm 106 and the upper surface of the plate 103 becomes larger than the force F2 that acts to bring the magnetic fluid 110 back to the range X. Accordingly, a part of the magnetic fluid 110 that has moved to the range Y' on the upper surface side of the plate 103 does not return to the range X but remains in the range Y', and thereby the amount of the magnetic fluid 110 held in the range X decreases. As a result, the sound emitted from the lower surface of the diaphragm 106, which has been blocked by the magnetic fluid 110, reaches the front surface of the diaphragm 106, and thus the possibility of reduction in the sound pressure is increased.

On the other hand, in the state shown in FIG. 2C, the plate 103 is composed of the protruding part 104 and the flat-plate part 105, and the planar portion P is provided at the outer periphery of the upper surface of the plate 103. Therefore, when the magnetic fluid 110 is in the range Y", the adhesive force, the cohesive force, and the magnetic force which act on the magnetic fluid 110 are the same as those in the state shown in FIG. 2A. Accordingly, as in the state shown in FIG. 2A, the force F2 that acts to bring the magnetic fluid 110 back to the range X becomes larger than the force F1 that acts to draw the magnetic fluid 110 into the space between the diaphragm 106 and the upper surface of the plate 103. Therefore, even if the magnetic fluid 110 temporarily moves to the range Y" on the upper surface side of the plate 103, the magnetic fluid 110 returns to the range X to be held between the plate 103 and the voice coil 107. That is, the shape of the plate 103 according to the present disclosure can prevent reduction in the sound pressure due to flow of the magnetic fluid 110 into the space between the diaphragm 106 and the upper surface of the plate 103.

Figure 3:
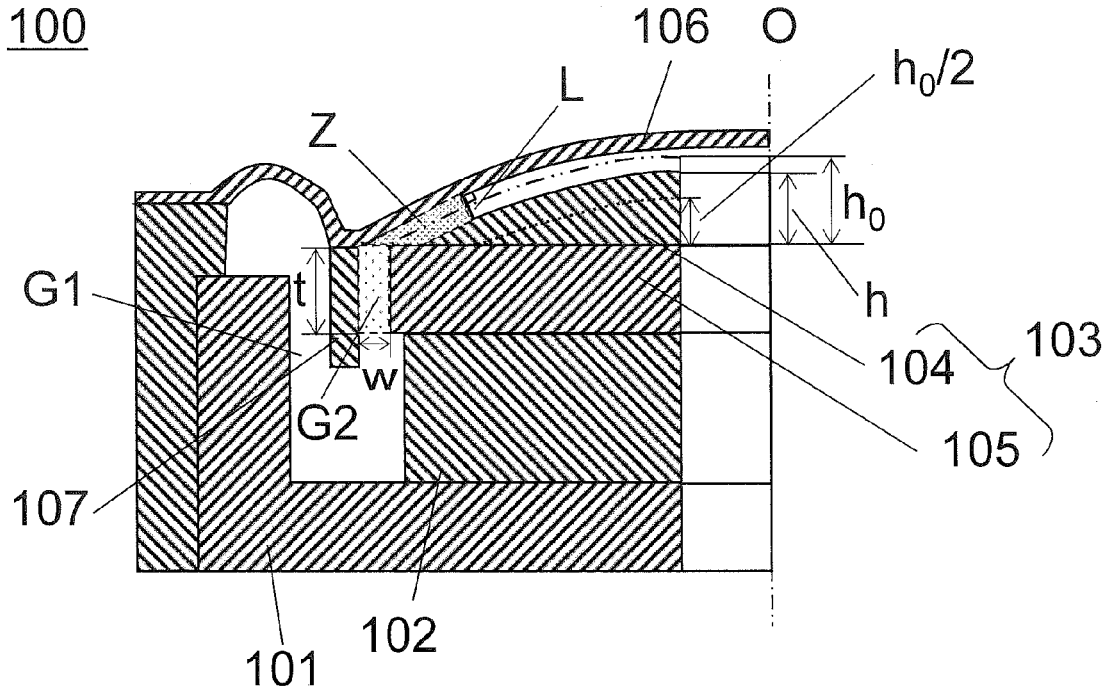
FIG. 3 is a schematic cross-sectional diagram showing a state where a diaphragm of the loudspeaker according to Embodiment 1 of the present disclosure is displaced at a maximum amplitude.

In order to achieve the object of the present disclosure more effectively, for example, the specific shape of the plate 103 may be determined by the following method. FIG. 3 is a schematic cross-sectional diagram showing a state where the diaphragm 106 is displaced toward the plate 103 at the maximum amplitude, in the loudspeaker 100 according to the present embodiment. FIG. 3 is a schematic cross-sectional diagram corresponding to a cross section taken along a dashed-dotted line A-O in FIG. 1A. In FIG. 3, the side of a surface having the diaphragm 106 is an upper side. When the diaphragm 106 is displaced toward the plate 103 at the maximum amplitude, a cross-sectional area S1 of a magnetic gap G2 in the magnetic gap G1, which gap G2 is produced between the inner side of the voice coil 107 and the lateral surface of the flat-plate part 105 of the plate 103, is expressed by the following equation (1):

$$S1=t\times w \quad (1)$$

where t is the height of the lateral surface of the flat-plate part 105 of the plate 103, and w is the distance between the inner side of the voice coil 107 and the lateral surface of the flat-plate part 105 of the plate 103.

Assuming that the protruding part 104 is provided from the outer edge portion of the flat-plate part 105 (when the protruding part 104 is provided as shown by a dashed-two-dotted line in FIG. 3), the height from the flat-plate part 105 to the top of the protruding part 104 is $h_0$. With the shape of the upper surface of the protruding part 104 being the same, the height h from the flat-plate part 105 to the top of the protruding part 104 is varied in a range of $h_0/2<h<h_0$, and the height of the protruding part 104 is determined so that a length L1 of a vertical line L satisfies the following equation (2), in a case where the position of the vertical line L is determined so that the area of a region Z surrounded by the lower surface of the diaphragm 106, the upper surface of the plate 103, and the upper surface of the magnetic gap G2, and the vertical line L extending from the protruding part 104 of the plate 103 to the diaphragm 106 becomes equal to the cross-sectional area S1.

$$L1>w \quad (2)$$

Figure 4:
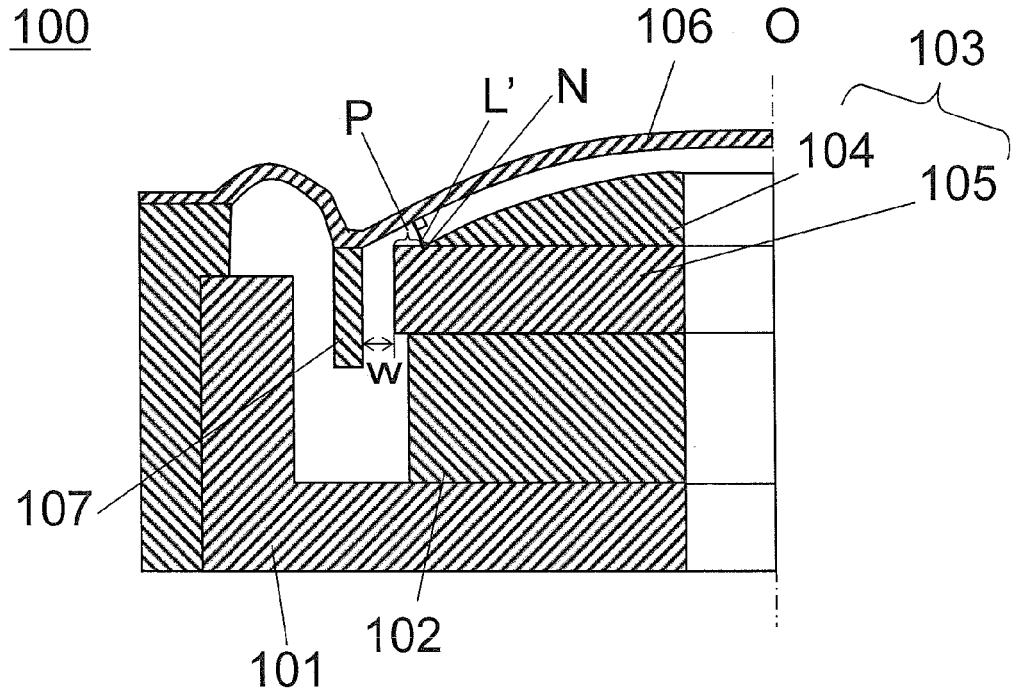
FIG. 4 is a schematic cross-sectional diagram showing a state where a diaphragm of the loudspeaker according to Embodiment 1 of the present disclosure is displaced at a maximum amplitude.

Alternatively, for example, the shape of the plate 103 may be determined by the following method. FIG. 4 is a schematic cross-sectional diagram showing the state where the diaphragm 106 is displaced toward the plate 103 at the maximum amplitude, in the loudspeaker 100 according to the present embodiment. FIG. 4 is a schematic cross-sectional diagram corresponding to a cross section taken along the dashed-dotted line A-O in FIG. 1A. In FIG. 4, the side of a surface having the diaphragm 106 is an upper side.

The shape of the plate 103 is determined so that, when the diaphragm 106 is displaced toward the plate 103 at the maximum amplitude, a length L2 of a vertical line L' extending from a point N on the planar portion P, which is closest to the protruding part 104, toward the diaphragm 106 satisfies the following equation (3):

$$L2>w \quad (3)$$

where w is the distance between the inner side of the voice coil 107 and the lateral surface of the flat-plate part 105 of the plate 103.

By determining the shape of the plate 103 as in the above two examples, even when the space between the diaphragm 106 and the upper surface of the plate 103 is the narrowest, the area of the contact surface of the magnetic fluid 110 and the air on the yoke 101 side (the end surface of the magnetic fluid 110 on the yoke 101 side) becomes smaller than the area of the contact surface of the magnetic fluid 110 and the air on the diaphragm 106 side (the end surface of the magnetic fluid 110 on the diaphragm 106 side). Accordingly, when the magnetic fluid 110 moves to the upper surface of the plate 103, the force that acts to bring the magnetic fluid 110 back to the original position becomes greater than the force that moves the magnetic fluid 110 to the upper surface of the plate 103, and therefore, it is possible to prevent the magnetic fluid 110 from flowing to the upper surface of the plate 103.

Further, in the present embodiment, the flat-plate part 105 of the plate 103 may be made of a high magnetic permeability material such as iron while the protruding part 104 of the plate 103 may be made of a low magnetic permeability material such as a plastic material, and the flat-plate part 105 and the protruding part 104 may be adhered to each other. By adopting this configuration, an inexpensive and easily-moldable plastic material can be used as a material of the protruding part 104 that does not contribute to improvement of the magnetic field of the magnetic gap G1, and thus the cost of the entire parts of the loudspeaker 100 can be reduced. Furthermore, in the loudspeaker 100, assuming that the side of a surface having the diaphragm is an upper side, dispersion of the magnetic flux caused by the upper surface of the plate 103 having the upward-convex shape is prevented, and the magnetic flux can be concentrated in the magnetic gap G1 as in the case where the plate 103 has a flat-plate shape as conventional.

The shape of the protruding part 104 of the plate 103 is not necessarily the curved-surface shape, and is not limited thereto. For example, the protruding part 104 may be formed by laminating, like steps, a plurality of plates having different upper-surface areas.

Figure 5A:
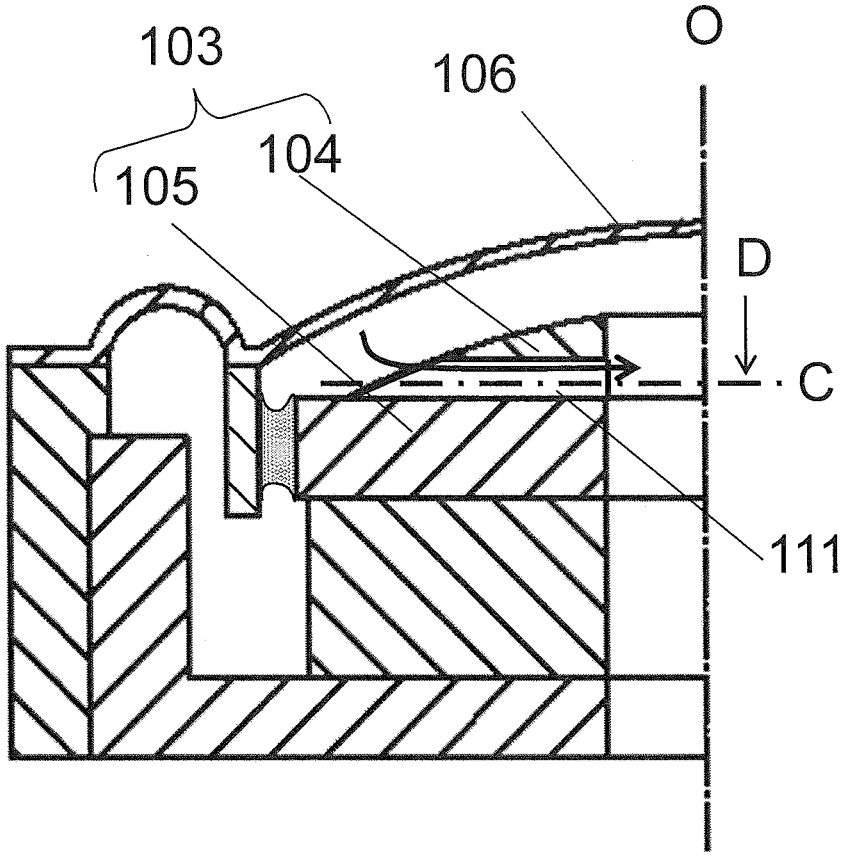
FIG. 5A is a schematic cross-sectional diagram showing a modification of the loudspeaker according to Embodiment 1 of the present disclosure.
Figure 5B:
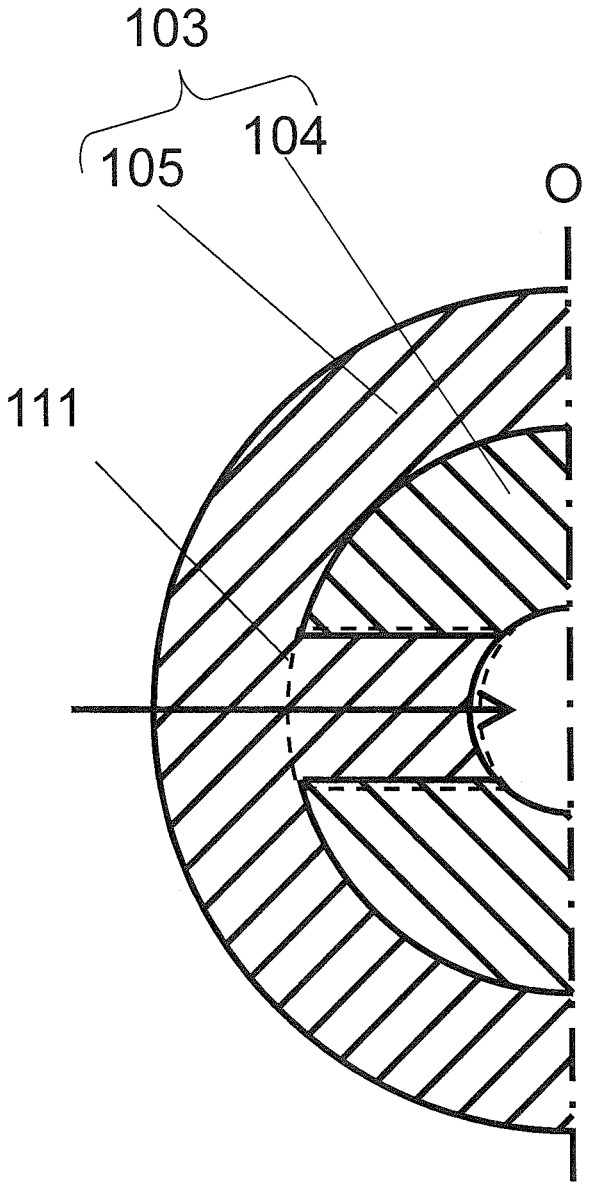
FIG. 5B is a schematic cross-sectional diagram taken along a dashed-dotted line C in FIG. 5A.

FIG. 5A is a schematic cross-sectional diagram showing a modification of the loudspeaker according to the present embodiment, and FIG. 5B is a schematic cross-sectional diagram taken along a dashed-dotted line C in FIG. 5A and viewed in the direction of an arrow D. As shown in FIGS. 5A and 5B, an air flow path 111 may be formed through the protruding part 104 disposed on the flat-plate part 105 of the plate 103. By so doing, the air resistance at the surface of the protruding part 104 can be increased, and thus the protruding part 104 can be used as a braking member.

Further, although the upper surface shape of the protruding part 104 of the plate 103 is substantially the same as the three-dimensional shape of the diaphragm 106, the upper surface shape is not limited thereto. The upper surface shape of the protruding part 104 of the plate 103 may be any shape such as a rectangle shape so long as the protruding part 104 protrudes upward from flat-plate part 105 so as to reduce the volume of the space between the diaphragm 106 and the upper surface of the plate 103.

Figure 6:
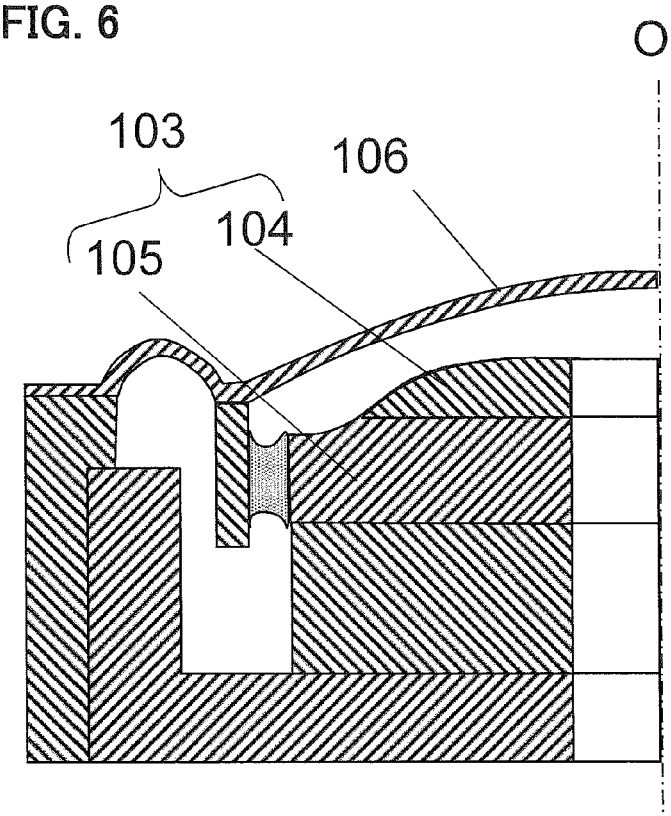
FIG. 6 is a schematic cross-sectional diagram showing a modification of the loudspeaker according to Embodiment 1 of the present disclosure.

Furthermore, although the upper surface shape of the flat-plate part 105 of the plate 103 (i.e., the shape of the planar portion P shown in the upper-left diagram in FIG. 1B) is a planar surface perpendicular to the vibration direction of the diaphragm 106, the upper surface shape of the flat-plate part 105 is not necessarily completely perpendicular to the vibration direction of the diaphragm 106. The upper surface shape of the flat-plate part 105 of the plate 103 may be any shape so long as the distance between the diaphragm 106 and the flat-plate part 105 becomes larger than the distance between the diaphragm 106 and the protruding part 104, and the present disclosure does not limit that the upper surface shape of the flat-plate part 105 is completely perpendicular to the vibration direction of the diaphragm 106. For example, as shown in FIG. 6, the upper surface shape of the flat-plate part 105 of the plate 103 may be a shape in which the distance between the diaphragm 106 and the flat-plate part 105 of the plate 103 is larger than the distance between the diaphragm 106 and the upper surface of the protruding part 104 of the plate 103.

Figure 7:
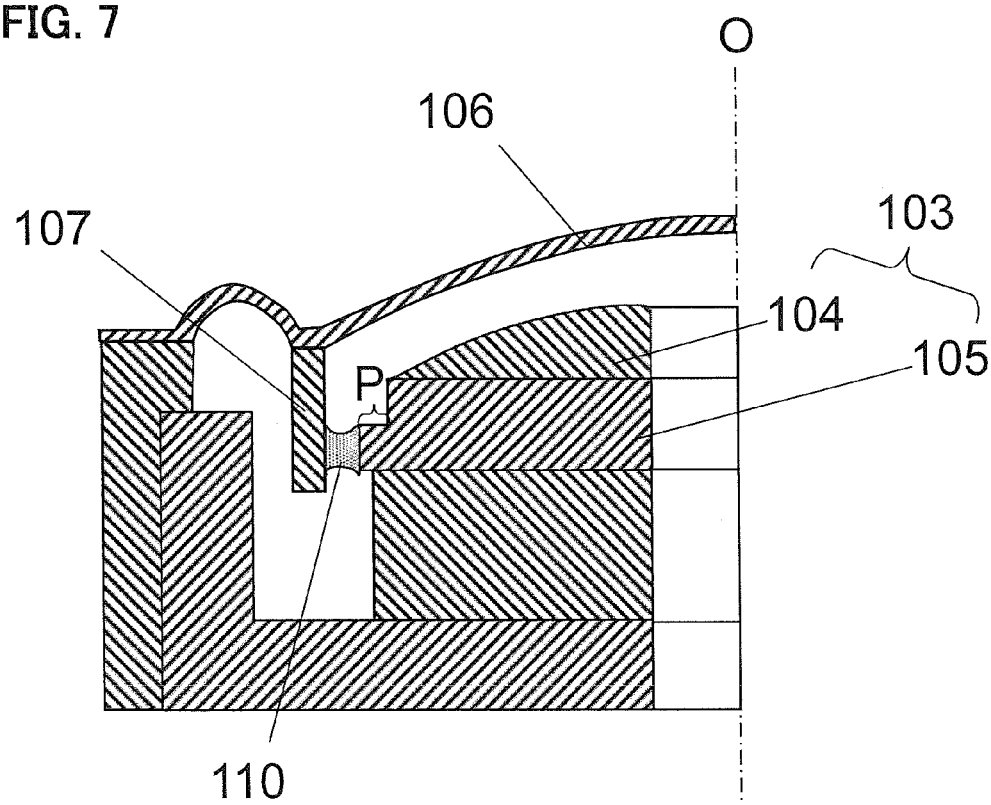
FIG. 7 is a schematic cross-sectional diagram showing a modification of the loudspeaker according to Embodiment 1 of the present disclosure.

Further, as shown in FIG. 7, assuming that the side of a surface having the diaphragm 106 is an upper side, a step-like cutout may be formed on the outer peripheral portion of the flat-plate part 105 including the planar portion P without changing the height of the flat-plate part 105 of the plate 103, thereby to form a step difference between the upper surface of the flat-plate part 105 (i.e., the planar portion P) and the upper surface of the outer peripheral portion of the protruding part 104, on the upper surface of the plate 103. By so doing, on the upper surface of the plate 103, the distance between the diaphragm 106 and the upper surface of the plate 103 is further increased only on the upper surface of the flat-plate part 105 in the vicinity of the upper side of the magnetic fluid 110. Accordingly, it is possible to prevent, more effectively, flow of the magnetic fluid 110 to the upper surface of the plate 103. In addition, since the area of the lateral surface of the flat-plate part 105 that acts as a magnetic pole, the magnetic flux passing through the voice coil 107 can be concentrated. Moreover, the amount of the magnetic fluid 110 needed to prevent the sound emitted from the lower surface of the diaphragm 106 from reaching the upper surface of the diaphragm 106 can be reduced.

Furthermore, an oil-repellent agent may be applied to only the upper surface of the flat-plate part 105 (i.e., the planar portion P shown in the upper-left diagram in FIG. 1B) on the upper surface of the plate 103. The oil-repellent agent thus applied prevents, more effectively, flow of the magnetic fluid 110 to the upper surface of the plate 103.

Figure 8A:
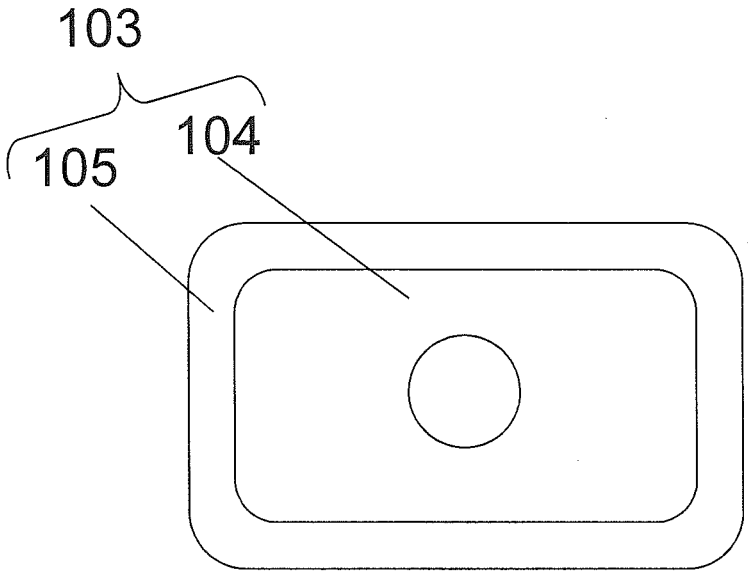
FIG. 8A is a top view showing a modification of a plate according to Embodiment 1 of the present disclosure.
Figure 8B:
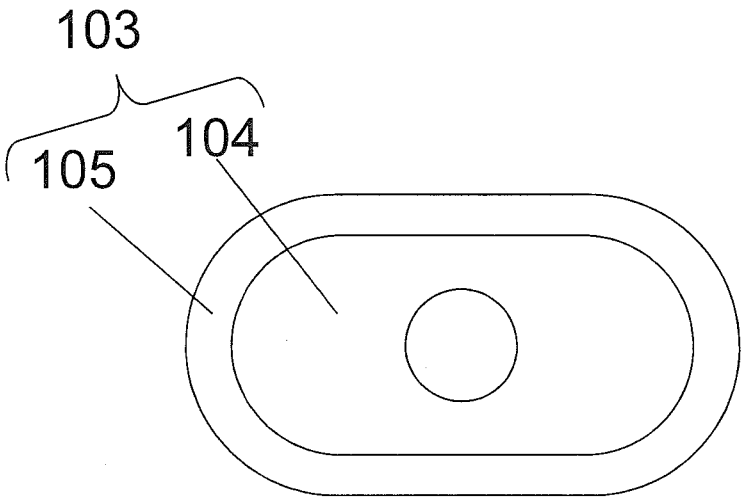
FIG. 8B is a top view showing a modification of the plate according to Embodiment 1 of the present disclosure.

Furthermore, in the loudspeaker 100, assuming that a surface having the diaphragm 106 is an upper surface, the diaphragm 106, the voice coil 107, and the plate 103 are circular in shape when viewed from the upper surfaces thereof, but the shapes of these components are not limited thereto. The diaphragm 106, the voice coil 107, and the plate 103 each may have a long shape, an oval shape, or a track shape. For example, as shown in FIG. 8A, the plate 103 may have a long shape when viewed from its upper surface. Alternatively, as shown in FIG. 8B, the plate 103 may have a track shape when viewed from its upper surface.

Figure 9:
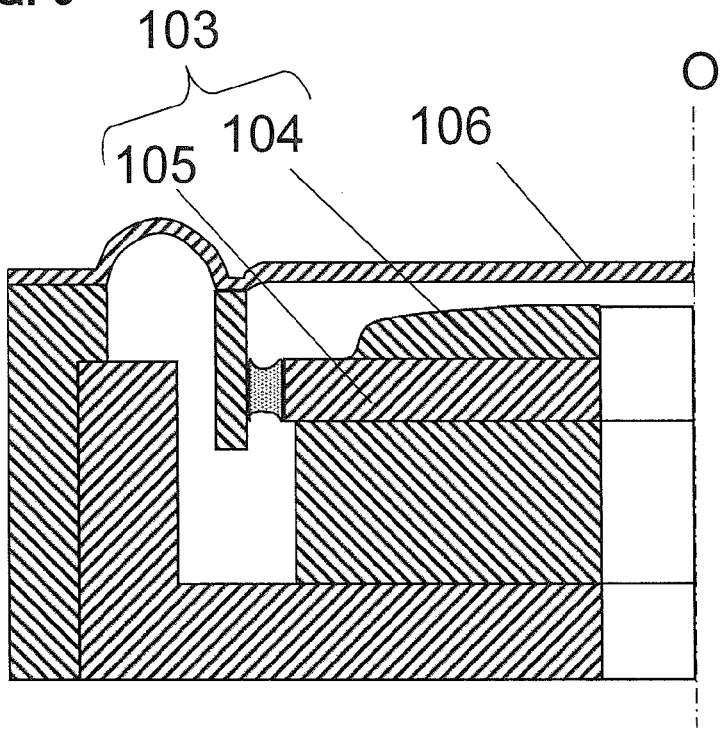
FIG. 9 is a diagram showing a modification of the loudspeaker according to Embodiment 1 of the present disclosure.

Furthermore, although the three-dimensional shape of the diaphragm 106 is a dome shape having a curvature, the three-dimensional shape of the diaphragm 106 is not limited thereto. The three-dimensional shape of the diaphragm 106 may be a combination of planes each having an inclination in the horizontal direction, or may be a planar shape. For example, as shown in FIG. 9, even when the diaphragm 106 has a planar shape, the plate 103 may be composed of the flat-plate part 105, and the protruding part 104 that is located on the flat-plate part 105 and inside the outer peripheral portion of the flat-plate part 105.

Further, although the loudspeaker 100 is an internal magnetic type loudspeaker, the loudspeaker 100 may be an external magnetic type loudspeaker. When the loudspeaker 100 is an external magnetic type loudspeaker, the plate 103 needs to be replaced with a yoke or a center pole.

As described above, in the loudspeaker 100 according to the present embodiment, the plate 103 includes the protruding part 104 that is located on the upper surface of the plate 103 and inside by a predetermined distance, and has a three-dimensional shape substantially the same as that of the diaphragm 106. Thereby, the volume of the space between the diaphragm 106 and the upper surface of the plate 103 can be reduced, and thus acoustic resonance is suppressed to prevent degradation of the sound quality. Further, the plate 103 includes the flat-plate part 105 having a planar portion P located at the outer periphery of the upper surface of the plate 103. Thereby, it is possible to suppress reduction in the sound pressure, caused by flow of the magnetic fluid 110 to the upper surface of the plate 103. Further, it is possible to prevent dispersion of the magnetic flux, as compared to the loudspeaker in which the outer peripheral portion of the upper surface of the plate 103 has a three-dimensional shape substantially the same as that of the diaphragm 106. That is, the cross-sectional area of the outer peripheral portion of the plate 103 is reduced, and thus the magnetic flux is concentrated and the density of the magnetic flux passing the voice coil 107 is increased. In addition, as described above, when a high magnetic permeability material is used as a material of the flat-plate part 105 while a low magnetic permeability material is used as a material of the protruding part 104, the magnetic flux passing the voice coil 107 can be concentrated, and a force that moves the magnetic fluid 110 to the upper surface of the plate 103 is prevented from acting on the magnetic fluid 110.

Figure 10:
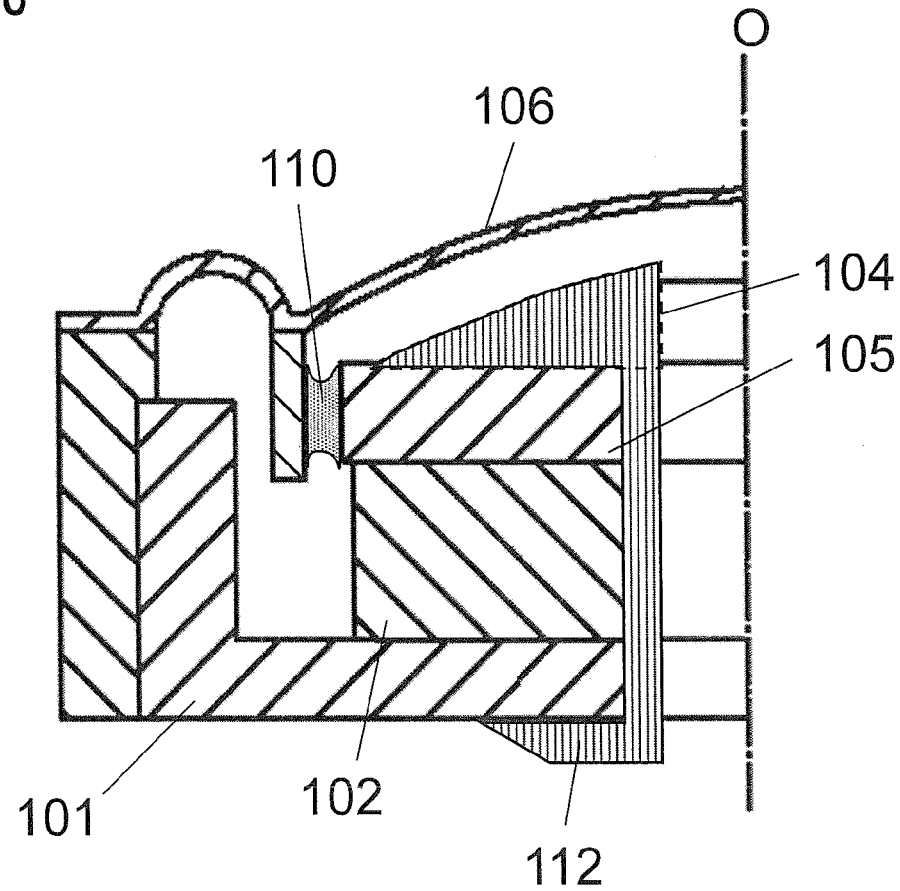
FIG. 10 is a diagram showing a modification of the loudspeaker according to Embodiment 1 of the present disclosure.

In the present embodiment, as shown in FIG. 10, the protruding part 104 of the plate 103 may be formed as follows. That is, a cylindrical member 112 is inserted in a through-hole formed by the flat-plate part 105, the magnet 102, and the yoke 101, and an end of the cylindrical member 112 on the flat-plate part 105 side (in FIG. 10, a portion surrounded by a dotted line) is worked into a dome shape. Thereby, in the manufacturing process, the adhesive strength of the plate 103, the magnet 102, and the yoke 101 can be enhanced simultaneously with formation of the protruding part 104, and thus cost reduction and improved reliability can be realized.

Figure 11:
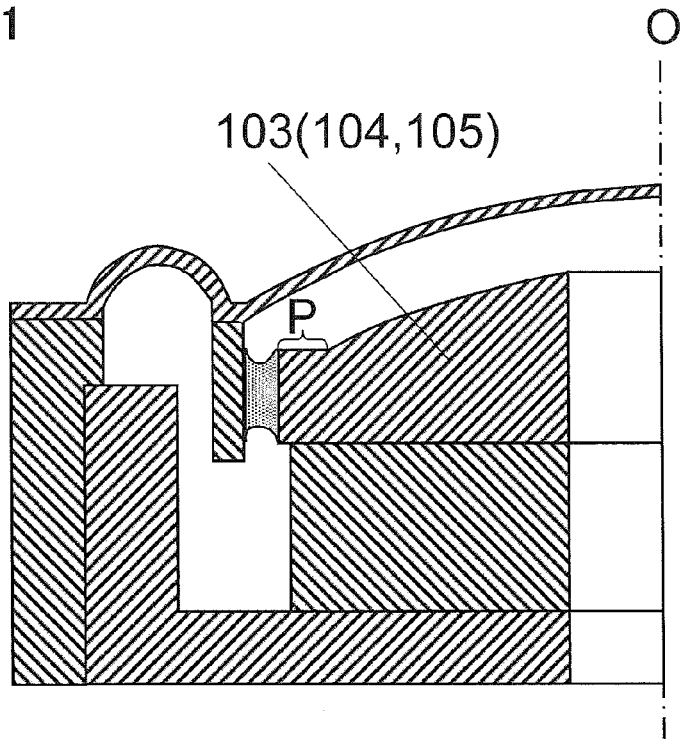
FIG. 11 is a diagram showing a modification of the loudspeaker according to Embodiment 1 of the present disclosure.

In the present embodiment, the protruding part 104 and the flat-plate part 105 of the plate 103 are formed as separated components. However, if the protruding part 104 and the flat-plate part 105 may have the same magnetic permeability, the protruding part 104 and the flat-plate part 105 may be formed as one component as shown in FIG. 11 to be used as the plate 103.

Embodiment 2

Hereinafter, a loudspeaker 200 according to Embodiment 2 will be described. The loudspeaker 200 is characterized in that, in the loudspeaker 100 of Embodiment 1, end portions of the edges 108*a* to 108*d* on the inner peripheral side of the loudspeaker 100 are connected not to the outer edge of the diaphragm 106 but to the upper surface of the diaphragm 106.

Figure 12A:
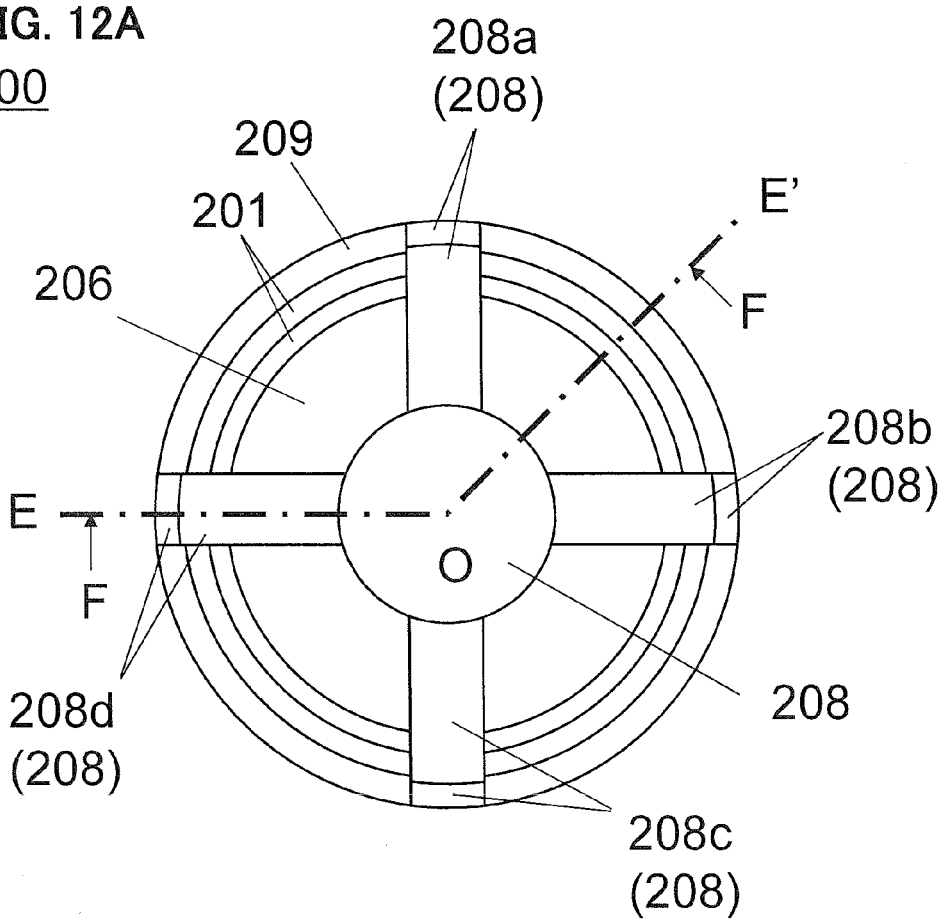
FIG. 12A is a top view of a loudspeaker according to Embodiment 2 of the present disclosure.
Figure 12B:
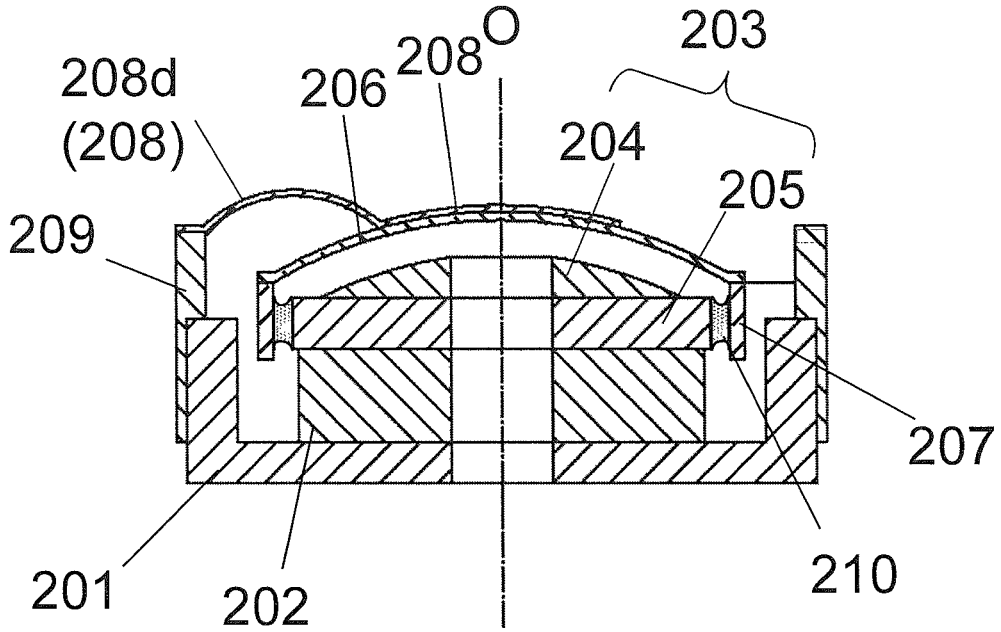
FIG. 12B is a schematic cross-sectional diagram taken along a dashed-dotted line E-O-E' in FIG. 12A.

FIG. 12A is a top view of the loudspeaker 200 according to the present embodiment. In the loudspeaker 200, the side of a surface having a diaphragm 206 is an upper side. FIG. 12B is a schematic cross-sectional diagram taken along a dashed-dotted line E-O-E' in FIG. 12A and viewed in the direction of an arrow F. The loudspeaker 200 is composed of a yoke 201, a magnet 202, a plate 203, a diaphragm 206, a voice coil 207, a support member 208, a frame 209, and a magnetic fluid 210. The plate 203 is composed of a protruding part 204 and a flat-plate part 205. Further, the support member 208 is composed of a plurality of edges (in FIG. 12A, four edges 208*a* to 208*d*). End portions of the edges 208*a* to 208*d* on the inner peripheral side of the loudspeaker 200 are connected to the upper surface of the diaphragm 206. Hereinafter, description of the configuration and operation of the loudspeaker 200 which are identical to those of Embodiment 1 will be omitted, and only the different points from Embodiment 1 will be described.

According to the loudspeaker 200, the lengths of the edges 208*a* to 208*d* can be increased. Therefore, the stiffness of the vibration system of the loudspeaker 200 can be reduced, thereby realizing excellent low-pitched sound reproduction. In addition, the lengths of portions of the edges 208*a* to 208*d* that are outside the diaphragm 206 when the loudspeaker 200 is viewed from the top can be made shorter than those of the loudspeaker 100 of Embodiment 1. Therefore, the outer diameter of the loudspeaker can be reduced without reducing the vibration area of the diaphragm 206.

Also in the loudspeaker 200, the plate 203 being composed of the protruding part 204 and the flat part 205 exerts the same effect as in the loudspeaker 100 of Embodiment 1. Accordingly, also in the loudspeaker 200, the reproduction band can be expanded without reduction in the sound pressure output performance caused by flow of the magnetic fluid 210 to the upper surface of the plate 203.

Installation Example 1

Figure 13:
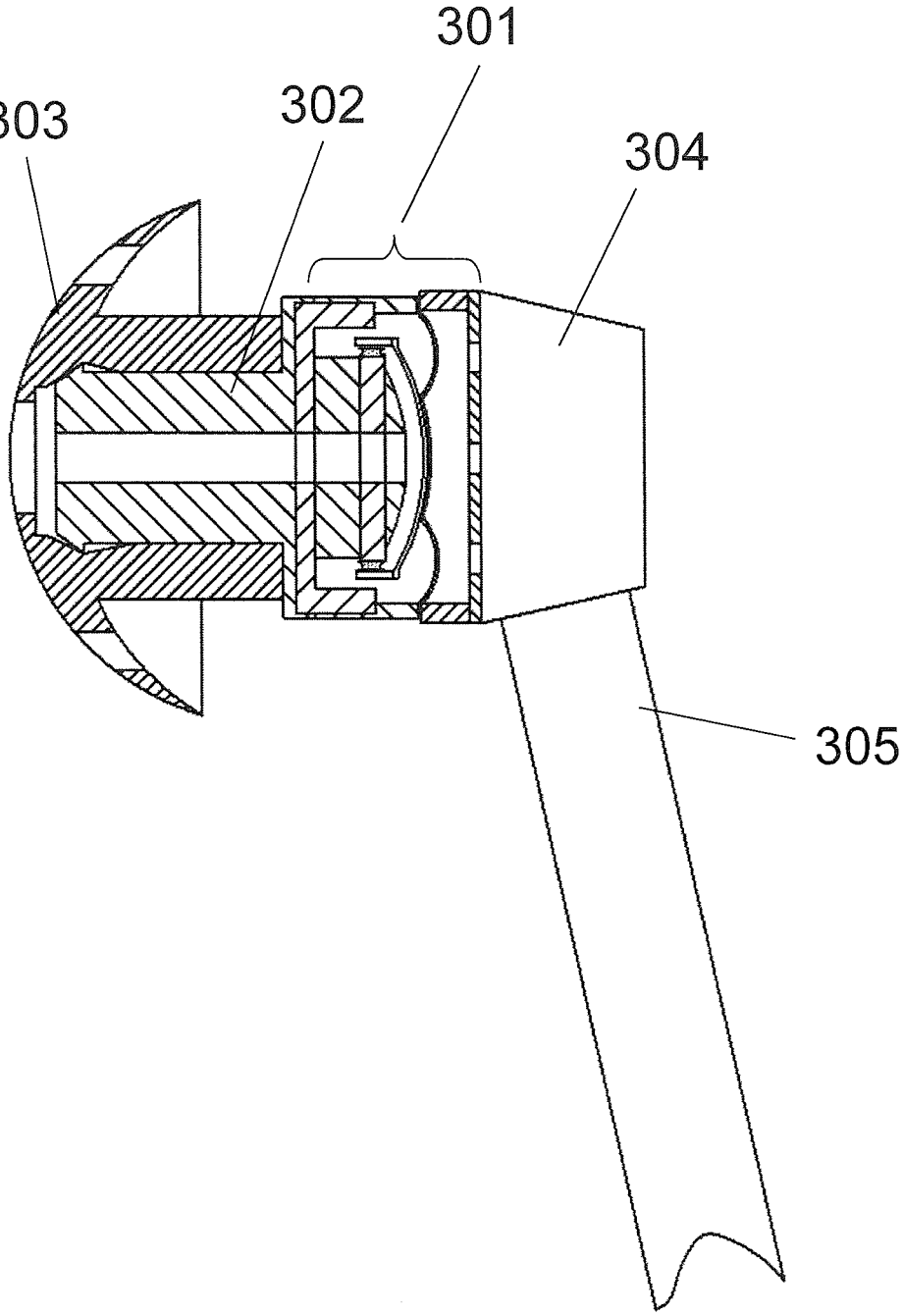
FIG. 13 is a partial cross-sectional view of an inner-ear headphone according to Installation Example 1 of the present disclosure.

FIG. 13 is a partial cross-sectional view of an inner-ear headphone according to the present installation example. With reference to FIG. 13, an example in which either of the loudspeakers according to Embodiments 1 and 2 is installed in an inner-ear headphone will be described. The inner-ear headphone shown in FIG. 13 includes a loudspeaker 301, a port 302, an ear chip 303, a housing 304, and a cord 305. The configuration of the loudspeaker 301 is based on the configuration of the loudspeaker according to Embodiment 1 or 2. While FIG. 13 shows an example in which the loudspeaker according to Embodiment 2 of the present disclosure is installed, the configuration and shape of the loudspeaker are not limited thereto, and may be those of the loudspeaker 100 according to Embodiment 1 of the present disclosure, or the other configurations and shapes described in Embodiment 1 of the present disclosure.

In the inner-ear headphone according to the present installation example, assuming that a surface having a diaphragm is an upper surface in the loudspeaker 301, a back surface of the diaphragm of the loudspeaker 301 is a sound wave emitting surface, and a listener can hear sound via the port 302 and the ear chip 303.

According to the inner-ear headphone of the present installation example, the loudspeaker 301 has the configuration of the loudspeaker of the present disclosure. Therefore, the small-size loudspeaker 301 yet can reproduce a wide frequency band from a low-pitched sound range to a high-pitched sound range, thereby providing an inner-ear headphone realizing both the improved wearing sensation and the high sound quality.

Installation Example 2

Figure 14:
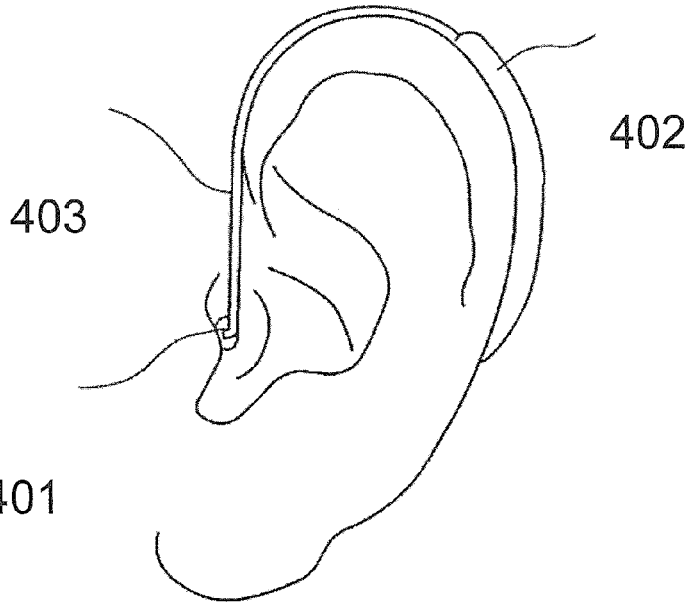
FIG. 14 is a diagram showing an example of an external appearance of a hearing aid according to Installation Example 2 of the present disclosure.

FIG. 14 is a diagram showing an example of an external view of a hearing aid according to the present installation example. With reference to FIG. 14, an example in which the loudspeaker according to Embodiment 1 or 2 of the present disclosure is installed in a hearing aid will be described. The hearing aid shown in FIG. 14 includes a receiver part 401, a hearing aid body 402, and a lead tube 403. The configuration of the receiver part 401 is based on the configurations of the loudspeaker 301, the port 302, and the ear chip 303 of the inner-ear headphone according to Installation Example 1 of the present disclosure.

According to the hearing aid of the present installation example, the loudspeaker of the receiver part 401 has the configuration of the loudspeaker of the present disclosure. Therefore, the small-size loudspeaker that causes a user to feel less discomfort when the hearing aid is inserted in his/her ear yet can cover a wider frequency band for hearing aid within an audible range, thereby providing a hearing aid applicable to various users who need different output characteristics.

In Installation Examples 1 and 2, the loudspeaker according to the present disclosure is installed in the inner-ear headphone and the hearing aid. However, equipment in which the loudspeaker can be installed is not limited thereto. For example, the loudspeaker of the present disclosure may be installed in a headset, a personal digital assistant, a display device, and the like.

INDUSTRIAL APPLICABILITY

A loudspeaker according to the present disclosure can realize both improvement of user's wearing sensation caused by size reduction, and improvement of performance caused by expanded reproduction frequency band, and is applicable to an inner-ear headphone, a hearing aid, a headset, a personal digital assistant, a display device, and other AV equipment.

DESCRIPTION OF THE REFERENCE CHARACTERS

100, 200, 301, 1000 loudspeaker
101, 201, 1010 yoke
102, 202, 1011 magnet
103, 203, 1012 plate
104, 204 protruding part
105, 205 flat-plate part
106, 206, 1013 diaphragm
107, 207, 1016 voice coil
108, 208, 1014 support member
108*a* to 108*d*, 208*a* to 208*d*, 1014*a* to 1014*d* edges
109, 209 frame
110, 210, 1017 magnetic fluid
111 air flow path
112 cylindrical member
302 port
303 ear chip
304 housing
305 cord
401 receiver part
402 hearing aid body
403 lead tube
1015 spacer
1018 dome-shaped space
G1, G2, G3 magnetic gap
P planar portion

The invention claimed is:

1. A loudspeaker, comprising:

a frame;

a yoke fixed to the frame;

a magnet fixed to the yoke;

a plate fixed to an upper surface of the magnet, the upper surface being opposite to a surface of the magnet which is fixed to the yoke;

a voice coil arranged, in a vibratable manner, in a first magnetic gap formed between the yoke and the plate;

a diaphragm having an outer edge portion joined to the voice coil;

a support member which supports the diaphragm in a vibratable manner, and includes a plurality of edges, one end of each of the edges being fixed to the frame, and a magnetic fluid disposed between the plate and the voice coil, wherein the plate comprises a flat-plate part which is fixed to the upper surface of the magnet, and has, at an upper surface thereof, a planar portion extending from the outer edge portion up to a predetermined distance, and a protruding part which is disposed on the flat-plate part excluding the planar portion, and protrudes toward the diaphragm, a through-hole is formed so as to penetrate through the yoke, the magnet, and the plate, the through-hole connecting a space outside the loudspeaker with a space at a back surface of the diaphragm, and the protruding part is arranged extending into the through-hole so as to fix the yoke, the magnet, and the plate.

2. The loudspeaker according to claim 1, wherein the diaphragm has a three-dimensional dome shape.

3. The loudspeaker according to claim 2, wherein a shape of an upper surface of the protruding part is similar to a three-dimensional shape of the diaphragm.

4. The loudspeaker according to claim 1, wherein an air flow path is provided through the protruding part.

5. The loudspeaker according to claim 1, wherein a step-like cutout is formed in an outer edge portion of the flat-plate part including the planar portion.

6. The loudspeaker according to claim 1, wherein an oil-repellent agent is applied to only the planar portion.

7. The loudspeaker according to claim 1, wherein a low magnetic permeability material is used as a material of the protruding part, and a high magnetic permeability material is used as a material of the flat-plate part.

8. An inner-ear headphone including the loudspeaker according to claim 1.

9. A hearing aid including the loudspeaker according to claim 1.

10. The loudspeaker according to claim 1, wherein the support member including the plurality of edges supports a part of the diaphragm, and does not support an entire periphery of the diaphragm.

11. The loudspeaker according to claim 1, wherein when the diaphragm is displaced toward the plate at a maximum amplitude, a length of a vertical line extending from a point on the planar portion, closest to the protruding part, to the diaphragm is larger than a distance between an inner side of the voice coil and a lateral surface of the flat-plate part.

* * * * *